United States Patent [19]

Beech, Jr. et al.

[11] Patent Number: 5,053,579

[45] **Date of Patent: * Oct. 1, 1991**

[54] PROCESS FOR UPGRADING UNSTABLE NAPHTHAS

[75] Inventors: James H. Beech, Jr., Wilmington, Del.; Francis P. Ragonese, Cherry Hill; James A. Stoos, Blackwood, both of N.J.; Sergei Yurchak, Media, Pa.

[73] Assignee: Mobil Oil Corporation, Fairfax, Va.

[ * ] Notice: The portion of the term of this patent subsequent to Nov. 27, 2007 has been disclaimed.

[21] Appl. No.: 437,137

[22] Filed: Nov. 16, 1989

[51] Int. Cl.[5] ..... C01C 2/02; C01C 2/04

[52] U.S. Cl. ..... 585/533; 585/518; 585/330; 208/70; 208/71; 208/88; 208/89

[58] Field of Search ..... 585/533, 518; 208/70, 208/71, 53

[56] References Cited

U.S. PATENT DOCUMENTS

| | | | |
|---|---|---|---|
| 2,558,137 | 6/1951 | Hipp | 585/533 |
| 3,960,978 | 6/1976 | Givens et al. | 585/533 |
| 4,070,411 | 1/1978 | Butler et al. | 585/533 |
| 4,417,087 | 11/1983 | Miller | 585/533 |
| 4,513,156 | 4/1985 | Tubak | 585/517 |
| 4,542,251 | 9/1985 | Miller | 585/533 |
| 4,544,792 | 10/1985 | Smith et al. | 585/533 |
| 4,554,396 | 11/1985 | Chang et al. | 585/533 |
| 4,675,460 | 6/1987 | Seddon et al. | 585/533 |
| 4,754,096 | 6/1988 | Chang et al. | 585/533 |
| 4,777,316 | 10/1988 | Harandi et al. | 585/517 |
| 4,973,790 | 11/1990 | Beech, Jr. et al. | 208/70 |

*Primary Examiner*—Helane E. Myers

*Attorney, Agent, or Firm*—Alexander J. McKillop; Charles J. Speciale; Richard D. Stone

[57] ABSTRACT

A process for upgrading of unstable olefins, naphthas, and dienes, such as coker naphthas, is disclosed. The olefins in the unstable naphthas are oligomerized over a shape selective zeolite to gasoline and distillate products. The dienes are catalytically converted by the same zeolite. Preferably, hydrogen is added to increase catalyst life. Feed pretreatment, to remove basic nitrogen compounds also improves catalyst life. Water washing of coker naphtha is the preferred method of removing basic nitrogen compounds.

19 Claims, No Drawings

PROCESS FOR UPGRADING UNSTABLE NAPHTHAS

BACKGROUND OF THE INVENTION

1. Field of the Invention

The invention relates to hydrocarbon processing. Specifically, the invention relates to upgrading of unstable naphthas, such as coker naphthas, to produce high quality distillate and motor fuel.

For years, poor quality or hard to process gasoline boiling range streams such as coker, visbreaker or pyrolysis naphtha, have been a problem for refiners.

These materials contain such high quantities of di-olefins, in addition to sulfur and nitrogen compounds, that they are extremely difficult to process in conventional refinery units. The large di-olefin content of such streams renders them extremely reactive or unstable. If an attempt is made to simply hydrotreat these streams in a conventional hydrotreater, the reactive di-olefins form gum which plugs the conventional hydrotreating bed, or less frequently plugs the heat exchanger or heater upstream of the hydrotreating unit.

These unstable naphthas are of such poor quality that they cannot be blended into the refinery gasoline pool. Refiners have resorted to some rather extreme steps in order to deal with these materials.

High pressure naphthas are of such poor quality that they cannot be blended into the refinery gasoline pool. Refiners have resorted to some rather extreme steps in order to deal with these materials.

High pressure hydrotreating, at reactor pressures of 1000–1500 psig, is one way to handle the problem. Coker naphthas, either alone, or with other naphtha boiling range stocks, are treated with a conventional hydrotreating catalyst (such as Co-Mo or Ni-Mo on a support such as alumina) in a hydrotreating reactor operating with an extremely high hydrogen partial pressure. This approach works, and reduces gum formation to tolerable levels, but high pressure hydrotreating is expensive, and not usually required for naphtha boiling range streams. A refiner having a source or coker naphtha must build a separate high pressure hydrotreater to handle the coker naphtha. If the coker naphtha is blended with conventional gasoline boiling range materials and hydrotreated, then the blend must be processed at high pressure. This means the hydrotreater must be a very large one, operating at high pressure.

Catalytic di-olefin conversion upstream of conventional hydrotreating is also possible. Such proprietary technology is available from various licensors. UOP, Inc. has offered Platfining process, which operates at very low temperatures, temperatures low enough so that gum formation does not occur. The catalyst is reportedly active enough even at these low temperatures to convert the di-olefins in the feed to something else. The product of such processes can then be co-mingled with other naphtha streams for conventional hydrotreating, reforming, etc. The drawback to this approach is that it requires an extra processing unit for the unstable naphtha stream upstream of the conventional naphtha upgrading processes.

Fluid catalytic cracking (FCC) processing of unstable, naphtha boiling range materials was reported in U.S. Pat. No. 4,051,013, which is incorporated herein by reference. The patentee used a hot, clean burned FCC catalyst to first contact an unstable naphtha fraction in a riser, with addition of gas oil feed in a downstream portion of the riser. The patentee reported that 1000 BPD of coker naphtha could be converted in this manner into 510 BPD of FCC gasoline, with the remainder being converted to coke (5 wt. %) and C4− (42 wt. %).

Hydroformylation of fluid coker naphtha was reported in U.S. Pat. No. 4,711,968, which is incorporated herein by reference. Using a special catalyst system, comprising a soluble rhodium or cobalt carbonyl complex catalyst, the patentee was able to achieve hydroformylation of many olefin containing streams. Although the hydroformylation process could proceed without prior purification, the patentee suggested various feed treatment steps, e.g., removal of mercaptans by extraction, and removal of sulfur, as well as nitrogen compounds, by adsorption on columns packed with polar solids such as silica, fuller's earth, bauxite. The use of zeolites to enrich the feeds in 1-n-olefins and n-paraffins was taught. Removal of aromatic compounds by selective solvent extraction was taught. Sulfur compounds could also be removed by passing cracked distillate through a high temperature fixed bed of bauxite, fuller's earth or clay.

Upgrading of pyrolysis gasoline from steam cracking to make ethylene, by passing the naphtha over Pd/Zn/ZSM-5 at 900 to 1200 F was disclosed in U.S. Pat. No. 4,097,367, which is incorporated by reference. The high temperature processing of the $C_5$+ fraction converted to aromatics everything boiling in the BTX range, yielding a liquid product with essentially no non-aromatic hydrocarbons boiling above 167° F. The patentee also discussed the general prejudice in these arts re. hydrogen, namely that ZSM-5 is known for conversion of olefins to aromatics, but preferably in the absence of hydrogen.

None of the above approaches provided a complete solution to the problem of upgrading unstable naphtha streams. High pressure hydrotreating is expensive and produces a low value product. Removal of di-olefins by selective catalysis adds a fairly expensive processing step which yields as a product a low value naphtha stream. The hydroformylation approach does not meet the needs of refiners who want to make gasoline and distillate.

None of the prior art processes provide a way to efficiently convert an unstable naphtha feed into more valuable liquid fuel components, comprising gasoline and distillate components. In the FCC processing of coker naphtha, only about half of the coker naphtha, by weight, is converted to a normally liquid product, with the rest converted to coke or light gases. Many refineries lack eitner the facilities, or the market, for production of more light material and for these reasons FCC processing of coker naphtha is not a good upgrading method.

We have discovered a way to efficiently upgrade these unstable naphthas to high octane gasoline and distillate boiling range components in a simple process which can operate for a long time at very mild operating conditions.

BRIEF SUMMARY OF THE INVENTION

Accordingly, the present invention provides a process for upgrading an unstable naphtha comprising dienes and olefins produced by thermal cracking of a heavy hydrocarbon feed comprising contacting the unstable naphtha with an upgrading catalyst comprising a zeolite having a Constraint Index of about 1 to 12, a silica to alumina mole ratio of at least 12 and an alpha value, on a pure zeolite basis, of at least 100, at oligomerization reaction conditions including a temperature naphtha feed space velocity, and catalyst alpha value sufficient to oligomerize at least a portion of the olefins in the feed to gasoline and distillate boiling range products and to catalytically convert a majority of the dienes in the feed to produce a gasoline and distillate boiling range product with a reduced diene content.

In another embodiment, the present invention provides a process for upgrading an unstable coker naphtha containing olefins and more than 0.25 wt. % dienes and more than 1.0 wt. ppm basic nitrogen compounds to stable gasoline and distillate boiling range products comprising reducing the basic nitrogen content of the feed by contacting the feed with a material selected from the group of water and acidic solids to reduce the basic nitrogen content below 0.1 wt. ppm; and upgrading the resulting unstable coker naphtha with a reduced basic nitrogen content by contact with an upgrading catalyst comprising a zeolite having a Constraint Index of about 1 to 12, a silica to alumina mole ratio of at least 12, and an alpha value, on a pure zeolite basis, of at least 100, at olefin oligomerization conditions including a temperature, hydrocarbon feed space velocity, and catalyst alpha value sufficient to oligomerize at least a portion of the olefins in the feed to produce a gasoline and distillate boiling range product and catalytically converting at least a majority of the dienes in the coker naphtha to produce a stable gasoline and distillate product with a reduced diene content of less than 0.1 wt. %.

In a more limited embodiment, the present invention provides a process for upgrading an unstable coker naphtha containing olefins and more than 0.25 wt. % dienes and more than 1.0 wt. ppm basic nitrogen compounds to stable gasoline and distillate boiling range products comprising reducing the basic nitrogen content of the feed below 0.05 wt. ppm basic nitrogen by contacting the feed with a material selected from the group of water and acidic solids to produce an unstable coker naphtha with a reduced basic nitrogen content; and upgrading the resulting unstable coker naphtha with a reduced basic nitrogen content by contacting the naphtha with an upgrading catalyst comprising ZSM-5 having a silica to alumina mole ratio of at least 12, and an alpha value, on a pure ZSM-5 basis, of at least 100, at olefin oligomerization conditions including a temperature of 250–450° F, a coker naphtha space velocity of about 0.1 to 10 to oligomerize at least a portion of the olefins in the feed to a gasoline and distillate boiling range product while catalytically converting at least a majority of the dienes in the coker naphtha to produce a stable gasoline and distillate product with a reduced diene content.

DETAILED DESCRIPTION

FEEDSTOCKS

The feedstocks which are suitable for use in the present invention are any naphtha fractions produced by thermal cracking processes, such as visbreaking, thermal cracking, or coking.

In general, high temperature thermal cracking, such as is encountered in coking processes, leads to the greatest production of di-olefins, and produces naphthas with the greatest degree of instability Thermal cracking and visbreaking operate at a lower severity, and produce naphthas which are not nearly so troublesome.

Expressed as equivalent reaction time (ERT) at 800° F, visbreaking severities typically are 500–1200, while thermal cracking severities are typically in the range of 1500–2000 ERT. Most coking operations, whether fixed or fluid bed, operate at severities in excess of 2500 ERT seconds.

Suitable naphtha feedstocks may be produced using the fluid-coking process described in U.S. Pat. Nos. 2,905,629; 2,905,733 and 2,813,916. The Flexicoking process may also be used. This process is identical to fluid-coking but converts coke to low BTU gas. Flexicoking is described in U.S. Pat. Nos. 3,661,543; 3,816,084; 4,055,484 and 4,497,705 Which are incorporated herein by reference.

The naphtha boiling range streams contemplated for use herein will usually comprise $C_4$–$C_{12}$+ materials, and preferably $C_5$–$C_{12}$. Expressed as a boiling range, the naphtha will usually have an initial boiling point of 60–150° F or above, and an end boiling point in the range of 300–400° F. The process of the present invention tolerates even heavier charge stocks, those having an end point up to 450 or 500° F, but such materials are usually considered too heavy for use in a refinery gasoline pool and for that reason are not preferred feedstocks for use herein. They may be included in the feedstock to the process of the present invention, and the heavy ends removed from the product by distillation.

The unstable naphthas contemplated as feedstocks tend to have ratios of n-olefins to paraffins in excess of 1. In the $C_6$ to $C_{12}$ range, these ratios frequently range from about 1.1 to 2.1. The ratio usually increases with increasing carbon numbers. Extensive analytical results of the composition of coker naphtha, and some of its characteristics, are reported in U.S. Pat. No. 4,711,968.

CATALYST

The catalyst preferred for use herein comprises a shape selective zeolite having a silica to alumina ratio of at least 12 and a constraint index of about 1 to 12.

Any zeolite having a constraint index of 1–12 can be used herein as a shape selective zeolite additive. Details of the Constraint Index test procedures are provided in J. Catalysis 67, 218–222 (1981) and in U.S. Pat. No. 4,711,710 (Chen et al), both of which are incorporated herein by reference.

Preferred shape selective zeolites are exemplified by ZSM-5, ZSM-11, ZSM-12, ZSM-23, ZSM-35, ZSM-48, ZSM-57 and similar materials.

ZSM-5 is described in U.S. Pat. No. 3,702,886, U.S. Reissue 29,948 and in U.S. Pat. No. 4.061,724 (describing a high silica ZSM-5 as "silicalite").

ZSM-11 is described in U.S. Pat. No. 3,709,979.
ZSM-12 is described in U.S. Pat. No. 3,832,449.
ZSM-23 is described in U.S. Pat. No. 4,076,842.
ZSM-35 is described in U.S. Pat. No. 4,016,245.
ZSM-57 is described in U.S. Pat. No. 4,046,859.

These patents are incorporated herein by reference.

Zeolites in which some other framework element is present in partial or total substitution of aluminum can be advantageous. Elements which can be substituted for part of all of the framework aluminum are boron, gallium, zirconium, titanium and other trivalent metals which are heavier than aluminum. Specific examples of such catalysts include ZSM-5 or zeolite beta containing boron, gallium, zirconium and/or titanium. In lieu of, or in addition to, being incorporated into the zeolite framework, these and other catalytically active elements can also be deposited upon the zeolite by any suitable procedure, e.g., impregnation.

When shape selective zeolites are added, preferably relatively high silica shape selective zeolites are used, i.e., with a silica/alumina ratio above 20/1, and more preferably with a ratio of 70/1, 100/1, 500/1 or even higher.

Preferably the shape selective zeolite is placed in the hydrogen form by conventional means, such as exchange with ammonia and subsequent calcination.

Preferably the zeolites have relatively high acid cracking activity, or alpha activity. Preferably the alpha value of the pure zeolite is in excess of 100, and most preferably is about 150 to 250.

The high acid activity allows the desired conversion reactions to be achieved at relatively low temperatures, discussed hereafter. Somewhat higher temperatures can be tolerated, but this will increase the rate of gum formation and increase catalyst deactivation rates.

The Alpha test indicates the catalytic cracking activity of a catalyst compared to a standard catalyst. The Alpha test measures the relative rate constant (rate of normal hexane conversion per volume of catalyst per unit time). Highly active silica-alumina cracking catalyst has an Alpha of 1 (Rate Constant =0.016 sec -1). The Alpha Test is described in U.S. Pat. No. 3,354,078, in the *Journal of Catalysis*, Vol. 4, p. 527 (1965); Vol. 6, p. 278 (1966); and Vol. 61, p. 395 (1980), which are incorporated herein by reference. The Alpha test used herein ran at a constant 538° C. with a variable flow rate, as described in the *Journal of Catalysis*, Vol. 61, p. 395.

PROCESS CONDITIONS

In general terms, the process of the present invention can be conducted within any of the process conditions heretofore found suitable for the conversion of olefins to gasoline and/or distillate components. More details of suitable process conditions may be taken from U.S. Pat. Nos. 4,150,062; 4,211,640 and 4,227,992 (Garwood et al) which are incorporated herein by reference.

It is essential to keep temperatures relatively low in the process of the present invention, because of the presence of large amounts of dienes in the feed.

The temperature, space velocity and catalyst alpha activity can all vary widely, so long as dienes are catalytically converted at temperatures low enough to substantially eliminate diene reactions that are thermally induced.

Acceptable, preferred, and most preferred reaction conditions are listed in the following table.

TABLE 1

| Process Conds. | Acceptable | Preferred | Most Preferred |
|---|---|---|---|
| Reactor Temp., F. | 200–700 | 225–500 | 250–450 |
| Pressure, psig | 0–1600 | 100–1000 | 300–500 |
| WHSV (on olefin) | 0.1–100 | 0.2–20 | 0.5–5 |
| Delta T, F Max. | 150 | 100 | 50 |
| H2 or inert mole % | 0–95 | 0–90 | 20–60 |

When a fluidized bed reaction zone is used, the delta T will usually be none, or just a few degrees. The above maximum delta T refers to operation of the reaction zone with a fixed bed or moving bed.

THE ROLE OF HYDROGEN

Although it is not essential to have hydrogen present during processing, the presence of hydrogen is beneficial in extending catalyst life and increasing distillate yields and conversion of reactants.

The role of hydrogen in the upgrading process is not completely understood. It is probably not reacting with oxygen compounds in the feed, as taught in U.S. Pat. No. 4,544,792, which is incorporated by reference. It is believed that the hydrogen does not act with any metal on the catalyst to hydrogenate dienes. The process works well when the catalyst is essentially free of hydrogenation/dehydrogenation components, e.g., when the zeolite is in the H-form.

It is surmised that the shape selective zeolites as used herein have the ability, at the reaction conditions specified above, to create small amounts of atomic hydrogen which is extremely reactive and which reacts with the diene components of the feed, or reactive intermediates formed by the dienes.

The hydrogen may also react with nitrogen impurities which are in the feed, and release ammonia, and this may in some way alter the selectivity of the catalyst. The hydrogen probably also hydrogenates, to some extent, coke precursors.

Some benefits will be seen when the feed contains as little as 1 to 5 mole % $H_2$. Although there is no theoretical upper limit on the amount of hydrogen that may be present it usually will not be economically justifiable to operate with more than about 90 mole % hydrogen in the reaction zone. Operation with 5 to 50 mole % H2 in the reaction zone is preferred, and operation with 10 to 30 mole % hydrogen is most preferred. Operation with at least 0.1 moles of hydrogen per mole of naphtha feed is preferred, with 0.2:1 to 1:1 $H_2$ naphtha ratios (molar basis) most preferred.

FEED PRETREATMENT

The unstable naphtha feed contains large amounts of dienes (rendering them unsuitable for conventional hydroprocessing) and large amounts of sulfur and nitrogen The nitrogen compounds, and to a lesser extent, the sulfur compounds, act as catalyst poisons. The feed is preferably pretreated to reduce the basic nitrogen content to less than 1 ppm, more preferably less than 0.5 wt. ppm, and ideally to less than 0.1 wt. ppm basic nitrogen, or 0.05 wt. ppm basic nitrogen, or less.

Water washing, preferably with a slightly acidified water stream, can reduce the combined nitrogen content of the feed to the desired level.

Other acidic substances may be used to pretreat the feed. Such acidic materials include ion exchange resins in the acid form, activated alumina, fresh or spent FCC catalyst, shape selective zeolites, and the like.

Process conditions for feed pretreatment, when using a solid bed include the following:

| | Acceptable | Preferred | Most Preferred |
|---|---|---|---|
| Temperature | 50–250 F. | 60–150 F. | 70–100 F. |
| Pressure | | liquid phase preferred | |
| LHSV | 0.01–100 | 0.1–50 | 0.5–20 |
| Maximum ppm N in Effluent | 1 | 0.1 | 0.05 |

PROCESS OPTIMIZATION

Preferably, feed pretreatment to reduce the total nitrogen content is coupled with hydrogen addition to the oligomerization reactor to achieve best results. To some extent, better feed preparation will compensate for lower hydrogen partial pressure, and vice versa. Ideally, essentially all of the basic nitrogen in the feed is removed by the feed pretreatment so that less than 0.05 ppm basic nitrogen remains in the feed to the oligomerization reactor.

Preferably hydrogen is present, in a roughly 1:1 molar ratio with naphtha feed.

Although fixed bed operation is preferred because of simplicity and low cost, it is also possible to operate with a fluidized bed or with a moving bed design, which permits continuous removal and replacement of spent catalyst. Swing reactors are another way to tolerate a higher catalyst aging rate while remaining on stream all the time.

REGENERATION

Although the practice of the present invention results in satisfactory catalyst cycle lengths, there will be a gradual accumulation of coke and gum material which will cause catalyst deactivation.

Hot hydrogen stripping will, in many instances, restore some catalyst activity. Conventional hydrogen stripping conditions may be used.

For complete regeneration of the catalyst, contact with an oxygen containing gas, preferably air added to a circulating nitrogen stream, can be used to burn off coke and gummy hydrocarbon deposits. Conventional catalyst regeneration conditions can be used.

We claim:

1. A process for upgrading an unstable naphtha comprising dienes and olefins produced by thermal cracking of a heavy hydrocarbon feed comprising contacting the unstable naphtha with an upgrading catalyst comprising a zeolite having a Constraint Index of about 1 to 12, a silica to alumina mole ratio of at least 12 and an alpha value, on a pure zeolite basis, of at least 100, at oligomerization reaction conditions including a temperature, naphtha feed space velocity, and catalyst alpha value sufficient to oligomerize at least a portion of the olefins in the feed to gasoline and distillate boiling range products and to catalytically convert a majority of the dienes in the feed to produce a gasoline and distillate boiling range product with a reduced diene content.

2. The process of claim 1 wherein the upgrading catalyst comprises ZSM-5, the unstable naphtha feed contains more than 1 wt. ppm of basic nitrogen compounds, and the basic nitrogen content of the feed is reduced by a feed pretreatment step prior to upgrading to reduce the basic nitrogen content of the feed below 1.0 wt. ppm basic nitrogen.

3. The process of claim 2 wherein the basic nitrogen content of the feed is reduced below 0.1 wt. ppm by pretreatment.

4. The process of claim 2 wherein the feed pretreatment to remove basic nitrogen compounds is selected from the group of water washing and contact with a solid, acidic material.

5. The process of claim 4 wherein the feed pretreatment comprises contact with a solid bed of a material selected from the group of silica gel, activated alumina, ion exchange resin, large pore zeolites, zeolites with a Constraint Index of about 1 to 12, and alumina.

6. The process of claim 1 wherein the thermal treatment process is selected from the group of visbreaking, thermal cracking and coking.

7. The process of claim 1 wherein the oligomerization reaction is conducted in the presence of hydrogen, at a mole ratio of hydrogen to unstable naphtha of about 0.1:1 to about 10:1.

8. The process of claim 1 wherein the oligomerization reaction conditions include a temperature of about 225–500° F, a naphtha weight hourly space velocity of 0.1 to 10, and a catalyst zeolite alpha activity sufficient to catalytically convert at least 90% of the diene content of the naphtha while thermally converting less than 10% of the diene content of the naphtha.

9. The process of claim 8 wherein the temperature is about 250–450° F, the catalyst zeolite alpha activity is above 150, and the naphtha weight hourly space velocity is 0.2 to 5.

10. A process for upgrading an unstable coker naphtha containing olefins and more than 0.25 wt. % dienes and more than 1.0 wt. ppm basic nitrogen compounds to stable gasoline and distillate boiling range products comprising:

a) reducing the basic nitrogen content of the feed by contacting the feed with a material selected from the group of water and acidic solids to reduce the basic nitrogen content below 0.1 wt. ppm; and b) upgrading the resulting unstable coker naphtha with a reduced basic nitrogen content by contact with an upgrading catalyst comprising a zeolite having a Constraint Index of about 1 to 12, a silica to alumina mole ratio of at least 12, and an alpha value, on a pure zeolite basis, of at least 100, at olefin oligomerization conditions including a temperature, hydrocarbon feed space velocity, and catalyst alpha value sufficient to oligomerize at least a portion of the olefins in the feed to produce a-gasoline and distillate boiling range product and catalytically converting at least a majority of the dienes in the coker naphtha to produce a stable gasoline and distillate product with a reduced diene content of less than 0.1 wt. %.

11. The process of claim 10 wherein the upgrading catalyst comprises ZSM-5 and the basis nitrogen content of the coker naphtha feed is reduced below 0.05 wt. ppm basic nitrogen.

12. The process of claim 10 wherein the basic nitrogen content of the coker naphtha feed is reduced by contact with a solid bed of a material selected from the group of silica gel, activated alumina, ion exchange resin, large pore zeolites, zeolites with a Constraint Index of about 1 to 12, and alumina.

13. The process of claim 10 wherein the olefin oligomerization reaction is conducted in the presence of hydrogen, at a mole ratio of hydrogen to coker naphtha of about 0.1:1 to about 0.5:1.

14. The process of claim 10 wherein the olefin oligomerization reaction conditions include a temperature of about 250–500° F, a coker naphtha weight hourly space velocity of 0.1 to 10, a pressure of 100 to 1000 psig, and a catalyst zeolite alpha activity sufficient to catalytically convert at least 90% of the diene content of the coker naphtha while thermally converting less than 10% of the diene content of the coker naphtha.

15. The process of claim 10 wherein the olefin oligomerization reaction is conducted at a coker naphtha weight hourly space velocity of 0.2 to 5, and the upgradi13 catalyst zeolite alpha activity is above 150.

16. The process of claim 10 wherein the olefin oligomerization reaction is conducted at a temperature of about 250–450° F and a naphtha weight hourly space velocity of 0.2 to 5.

17. A process for upgrading an unstable coker naphtha containing olefins and more than 0.25 wt. % dienes and more than 1.0 wt. ppm basic nitrogen compounds to stable gasoline and distillate boiling range1products comprising:

a) reducing the basic nitrogen content of the feed below 0.05 wt. ppm basic nitrogen by contacting the feed with a material selected from the group of water and acidic solids to produce an unstable coker naphtha with a reduced basic nitrogen content; and b) upgrading the resulting unstable coker naphtha with a reduced basic nitrogen content by contacting the naphtha with an upgrading catalyst comprising ZSM-5 having a silica to alumina mole ratio of at least 12, and an alpha value, on a pure ZSM-5 basis, of at least 100, at olefin oligomerization conditions including a temperature of250–450° F, a coker naphtha space velocity of about 0.1 to 10 to oligomerize at least a portion of the olefins in the feed to a gasoline and distillate boiling range product while catalytically converting at least a majority of the dienes in the coker naphtha to produce a stable gasoline and distillate product with a reduced diene content.

18. The process of claim 17 wherein the upgrading reaction is conducted in the presence of hydrogen, at a mole ratio of hydrogen to coker naphtha of about 0.1:1 to about 10:1.

19. The process of claim 17 wherein the basic nitrogen content of the feed is reduced by contacting the feed with water.

* * * * *